US010173835B2

(12) United States Patent
Lappeman

(10) Patent No.: US 10,173,835 B2
(45) Date of Patent: Jan. 8, 2019

(54) WASTE COLLECTION CONTAINER WITH WATER SEPARATION RESERVOIR

(71) Applicant: Wayne Lappeman, Coral Springs, FL (US)

(72) Inventor: Wayne Lappeman, Coral Springs, FL (US)

( * ) Notice: Subject to any disclaimer, the term of this patent is extended or adjusted under 35 U.S.C. 154(b) by 87 days.

(21) Appl. No.: 15/368,060

(22) Filed: Dec. 2, 2016

(65) Prior Publication Data

US 2018/0155122 A1 Jun. 7, 2018

(51) Int. Cl.
*B65F 1/02* (2006.01)
*B65F 1/14* (2006.01)
*B65F 1/16* (2006.01)

(52) U.S. Cl.
CPC ..... *B65F 1/02* (2013.01); *B65F 1/1452* (2013.01); *B65F 1/1473* (2013.01); *B65F 1/1646* (2013.01); *B65F 2210/132* (2013.01)

(58) Field of Classification Search
CPC ..... B65F 1/02; B65F 1/1473; B65F 1/1646; B65F 1/1452; B65F 2210/132
USPC ..... 210/474, 300, 241, 305, 306, 312, 455, 210/482, 244, 248, DIG. 8
See application file for complete search history.

(56) References Cited

U.S. PATENT DOCUMENTS 2,649,965 A * 8/1953 King ..... B62B 3/008 210/172.1
4,929,353 A * 5/1990 Harris ..... B01D 29/05 210/237
7,883,620 B2 * 2/2011 Owen ..... E03C 1/26 210/234
8,858,794 B2 * 10/2014 Lappeman ..... B01D 21/0012 210/241

* cited by examiner

*Primary Examiner* — Madeline Gonzalez
(74) *Attorney, Agent, or Firm* — Robert M. Downey, P.A.

(57) ABSTRACT

A waste collection container has vertical walls extending up from a horizontal base and a raised floor supported on a ledge above the base to define a primary collection chamber above the raised floor and a liquid collection reservoir between the base and the raised floor. The top surface of the raised floor is sloped downwardly from the outer periphery to a central elongate grate to direct rain water and other liquid in the primary collection chamber to the grate and into the lower liquid collection chamber. When the waste collection container is inverted to dump the collected waste into a truck, water and other liquid remains trapped in the lower reservoir, thereby reducing the load weight of the truck. One or more drain holes near the base of the container allow the liquid to be drained out of the liquid collection reservoir.

8 Claims, 6 Drawing Sheets

WASTE COLLECTION CONTAINER WITH WATER SEPARATION RESERVOIR

BACKGROUND OF THE INVENTION

Field of the Invention

This invention relates to waste collection containers and, more particularly, to a waste collection container that separates water and liquid contents from waste materials prior to transfer into a truck or other waste transportation vehicle.

Discussion of the Related Art

Waste collection containers (often referred to as "dumpsters") are used for collecting larger volumes of waste for periodic pickup by a waste collection service. Waste collection containers are usually placed at locations where waste management is necessary, such as at a construction site or a building having a large number of occupants. While it is normally intended to limit the type of collected waste to a specific class of materials, such as dry construction and demolition debris for example, the reality is that all types of waste items tend to get deposited in waste collection containers. Eventually, the containers are emptied by the collection service. In most instances, waste collection containers are lifted up and inverted over a collection truck causing the collected contents to be dumped into the truck for transport to a waste disposal facility.

Often, waste that is dumped into the waste collection container includes liquid or it is saturated with water. Moreover, when it rains, rain water begins to fill up in the waste collection container and the contents become saturated and heavy. When the collection truck comes to dump the contents of the container into the truck for transport to a landfill or other disposal facility, all of the rain water and other liquid is dumped into the truck, along with the collected waste. The liquid that is collected in the collection container, both from the dumped waste contents, as well as from rain water, adds significant weight to the load being transported by the collection truck. Naturally, the added weight of the load carried by the truck, as a result of the water contents dumped therein, significantly increases the fuel consumption of the truck, as well as the necessary weight capacity of the truck for carrying waste to be disposed of at the landfill or other disposal facility. In other words, bigger trucks that haul heavier loads and burn more fuel are needed to accommodate the extra weight created by unwanted water content in the waste load.

The typical waste collection container in the related art includes a drain opening near the bottom, usually at the back lower corner. This allows rain water and other liquid to drain from the container. However, because garbage and other debris are deposited into the container and initially fill the bottom of the container, next to the drain opening, this drain opening is usually either partially obstructed or completely blocked (i.e., clogged) by garbage or other debris that prevents rain water and other liquid from draining out from the container.

Accordingly, to increase the efficiency of waste collection services, and to maximize revenues, it is desirable to eliminate as much water and other liquid as possible from the collected waste contents of waste collection containers, prior to dumping the collected waste into a transportation truck or other vehicle.

SUMMARY OF THE INVENTION

The present invention is directed to a waste collection container that includes vertical walls extending up from a horizontal base and a raised floor supported on a ledge above the base to define a primary collection chamber above the raised floor and a liquid collection reservoir between the base and the raised floor and defining a liquid separation sump. The top surface of the raised floor is sloped downwardly from the outer periphery to a central elongate grate to direct rain water and other liquid in the primary collection chamber to the grate and into the lower liquid collection chamber. When the waste collection container is inverted to dump the collected waste into a truck, water and other liquid remains trapped in the lower reservoir, thereby reducing the load weight of the truck. One or more drain holes near the base of the container allow the liquid to be drained out of the liquid collection reservoir.

OBJECTS AND ADVANTAGES OF THE INVENTION

Considering the forgoing, it is a primary object of the present invention to provide a waste collection container that separates rain water, water from waste contents dumped in the container, and other liquid contents in an isolated collection reservoir so that when the waste container is inverted and dumped into a waste collection service truck, the collected water and other liquid is not released into the truck, thereby minimizing the weight load carried by the waste collection truck.

It is still a further object of the present invention to provide a waste collection container that has a raised floor that is sloped downward to a centrally located drain grate for directing water and other liquids into a segregated liquid collection reservoir.

It is still a further object of the present invention to provide a system that can be retrofitted to existing waste collection containers with the addition of a simple ledge around the inner wall perimeter of the container and attachment of a raised floor to the ledge, to thereby support the raised floor in spaced relation above a bottom of the waste collection container, and wherein the raised floor is sloped downwardly to a centrally located drain grate for directing water and other liquids into a segregated liquid collection reservoir below the raised floor.

It is still a further object of the present invention to provide a waste collection container that has a pitched or sloped raised floor and a centrally located drain grate having a drain grate cover to prevent debris and other waste materials from being wedged or clogged in the drain grate.

It is still a further object of the present invention to provide a waste collection container having a raised floor that is sloped downwardly to a drain grate for allowing water and other liquid to be directed into a segregated liquid collection reservoir below the raised floor, and wherein the waste collection container further includes a drain hole communicating with the liquid collection reservoir for draining water and other liquids from the reservoir.

These and other objects and advantages of the present invention are more readily apparent with reference to the following detailed description taken in conjunction with the accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
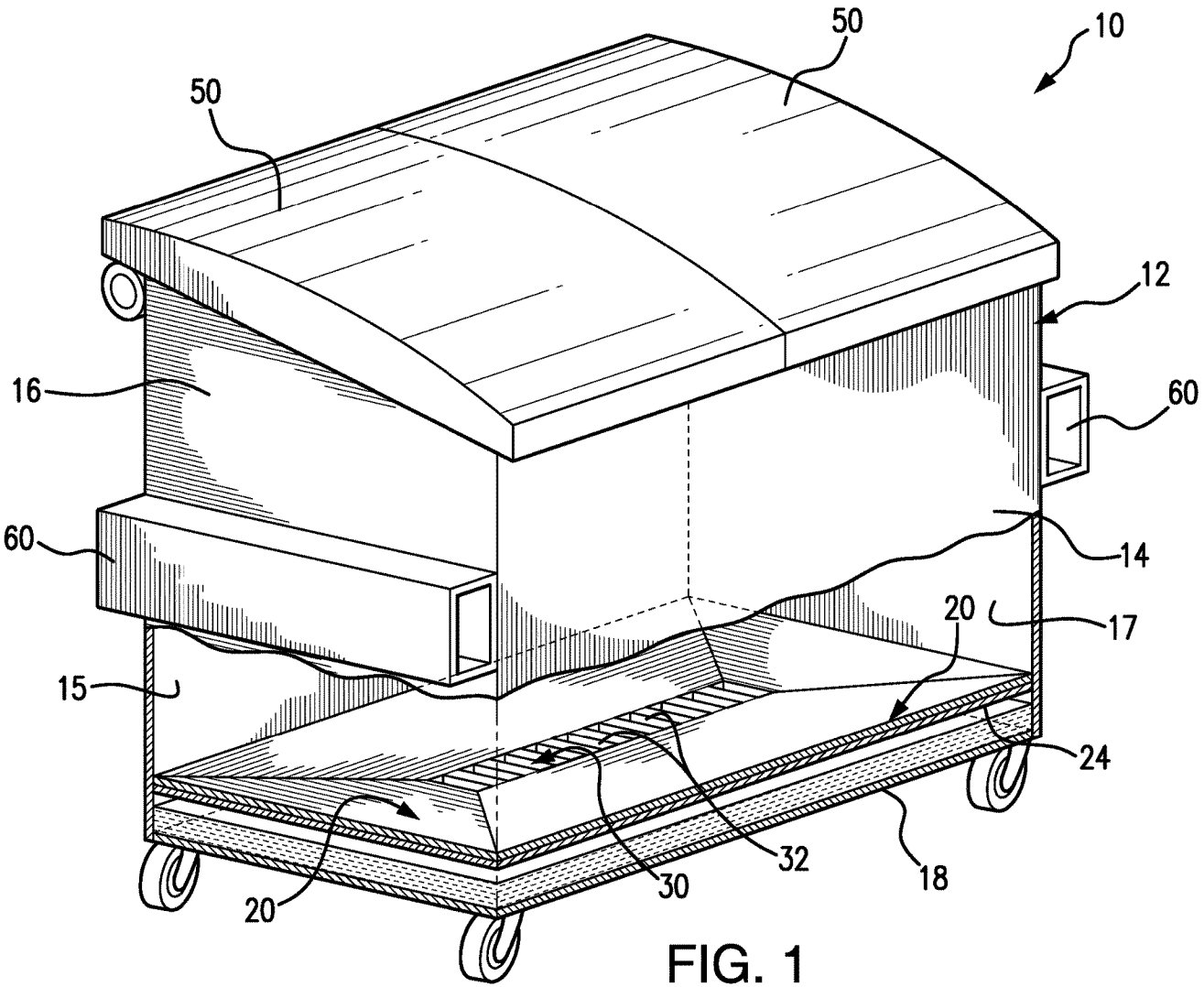
FIG. 1 is a front, top perspective view, in partial cutaway, of one embodiment of the waste collection container of the present invention.
Figure 2:
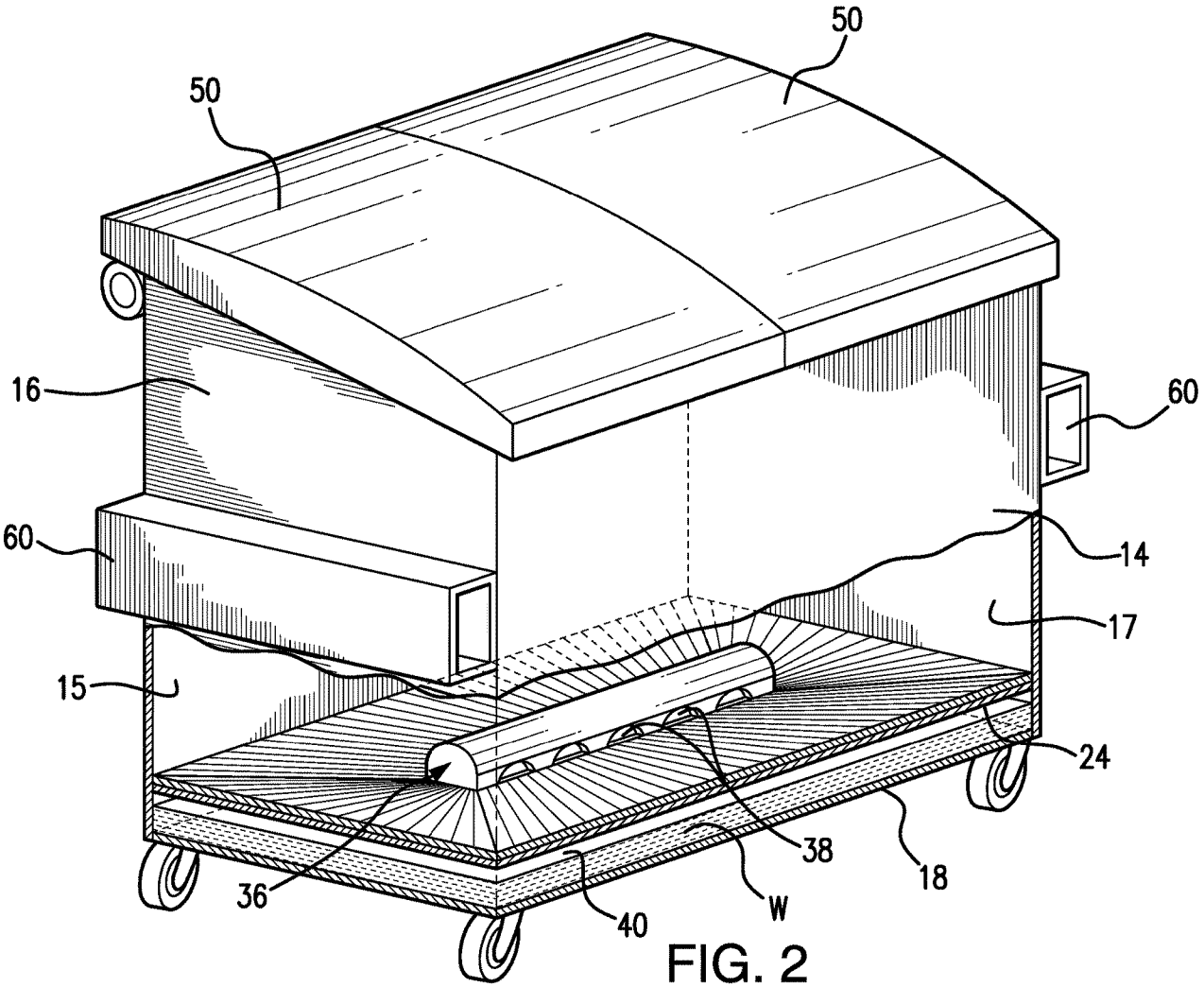
FIG. 2 is a front, top perspective view, in partial cutaway, showing another embodiment of the waste collection container of the present invention.
Figure 3:
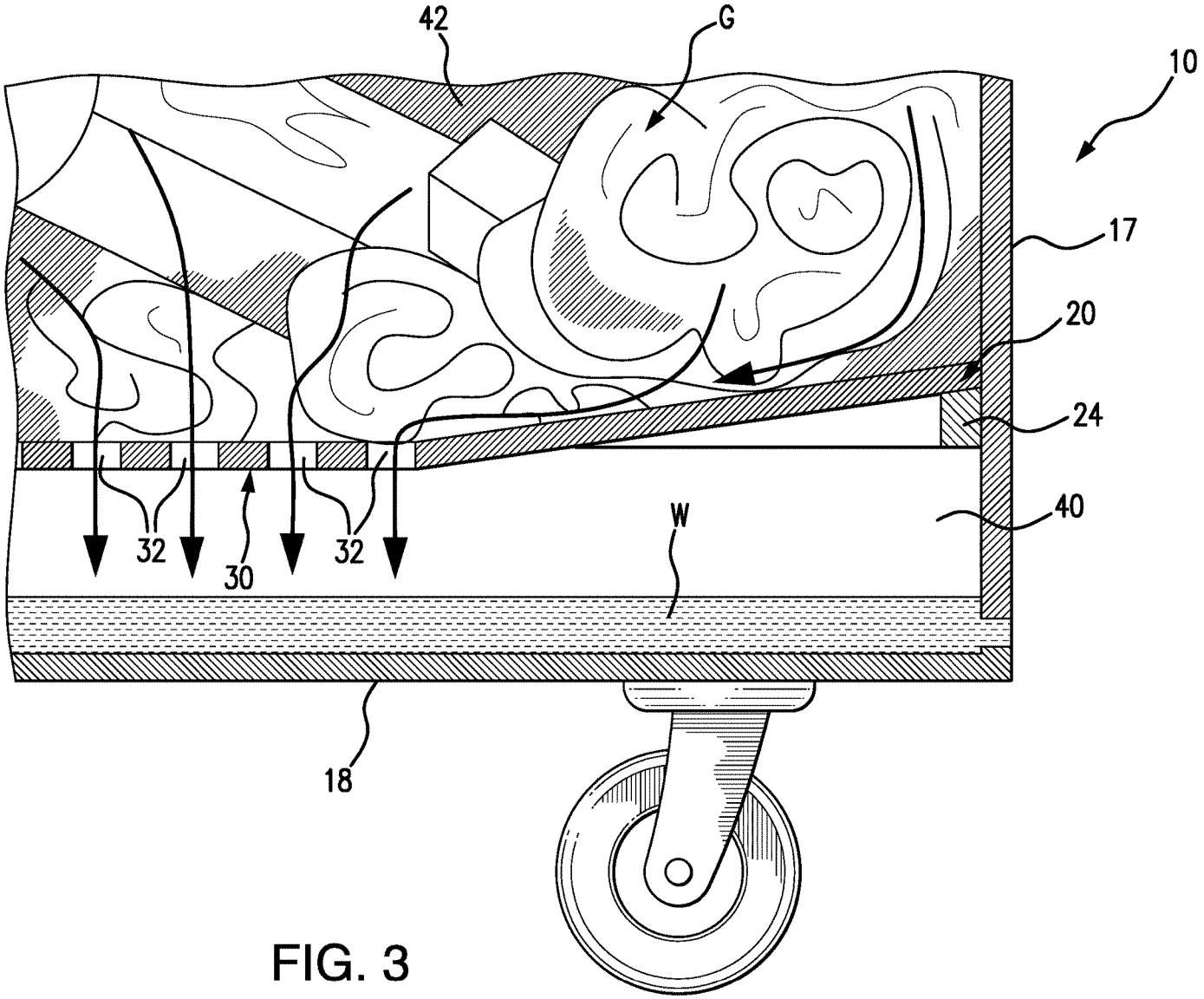
FIG. 3 is an isolated cross-sectional view of the waste collection container of FIG. 1.
Figure 4:
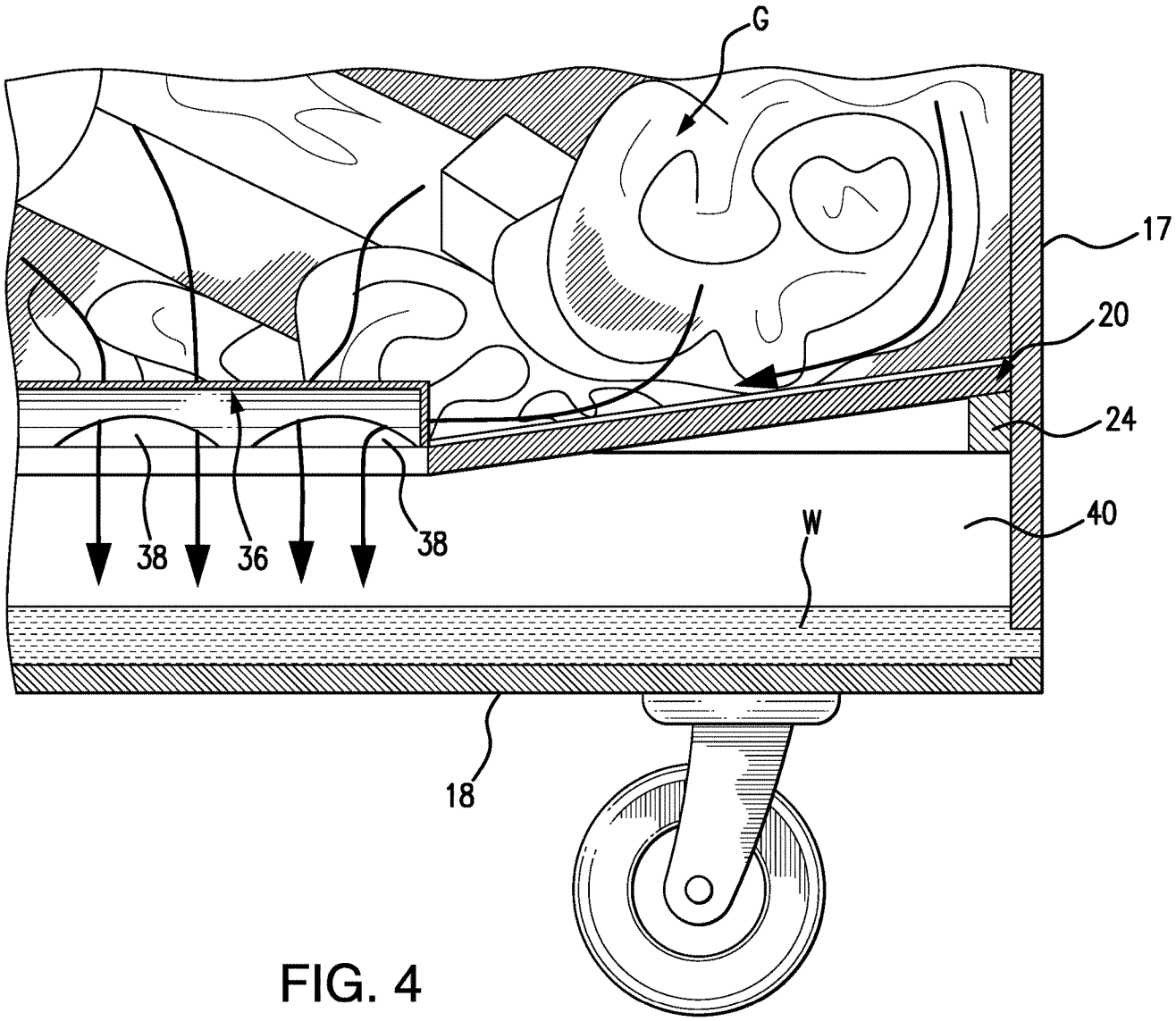
FIG. 4 is an isolated cross-sectional view of the waste collection container of FIG. 2.

Referring to the several views of the drawings, the waste collection container is shown and is generally indicated as 10. The waste collection container includes a container body 12 including a front wall 14, a rear wall 15, opposite side walls 16, 17 and a base 18. The top of the container body 12 is open and can be covered to prevent rain water and animals from entering into the container. As seen in FIGS. 1 and 2, hinged lids or covers 50 are provided and are movable between a closed position and an open position to allow deposit of garbage G and other waste materials within the container body 12. The waste collection container 10 further includes a raised floor 20 that is supported on a ledge 24 that extends around at least portions of the inner perimeter of the container body 12 on the inner surface of the walls 14-16 to support the raised floor 20 above the base 18. The ledge 24 is preferably welded to the inner surface of the walls 14-16 of the container body 12 and the raised floor is welded to the top of the ledge, as seen in FIGS. 3 and 4. The supported positioning of the raised floor 20 serves to create two segregated chambers within the container body 12, including a liquid collection chamber 40 below the floor 20 and defined by the space between the base 18 and the floor 20, and a primary waste collection chamber 42 above the floor 20. In use, garbage G and other waste materials are deposited through the open top of the container body 12 and into the primary waste collection chamber 42 as seen in FIGS. 3 and 4.

The raised floor 20 is sloped on all sides, including the front side, the rear side, and the opposite left and right sides downwardly to a centrally located elongate drain grate 30. The drain grate 30 includes arrangement of spaced, parallel open slots 32 communicating between the primary collection chamber 42 and the liquid collection chamber 40. The downwardly sloped floor 20 directs rain water and other liquid W from the primary collection chamber downwardly to the drain grate 30. The open slots 32 allow the water to run down into the lower liquid collection chamber 40 below the floor 20. The top surface of the sloped raised floor 20 may be flat, ridged or corrugated for optimal draining and direction of liquid to the drain grate 30.

Figure 5:
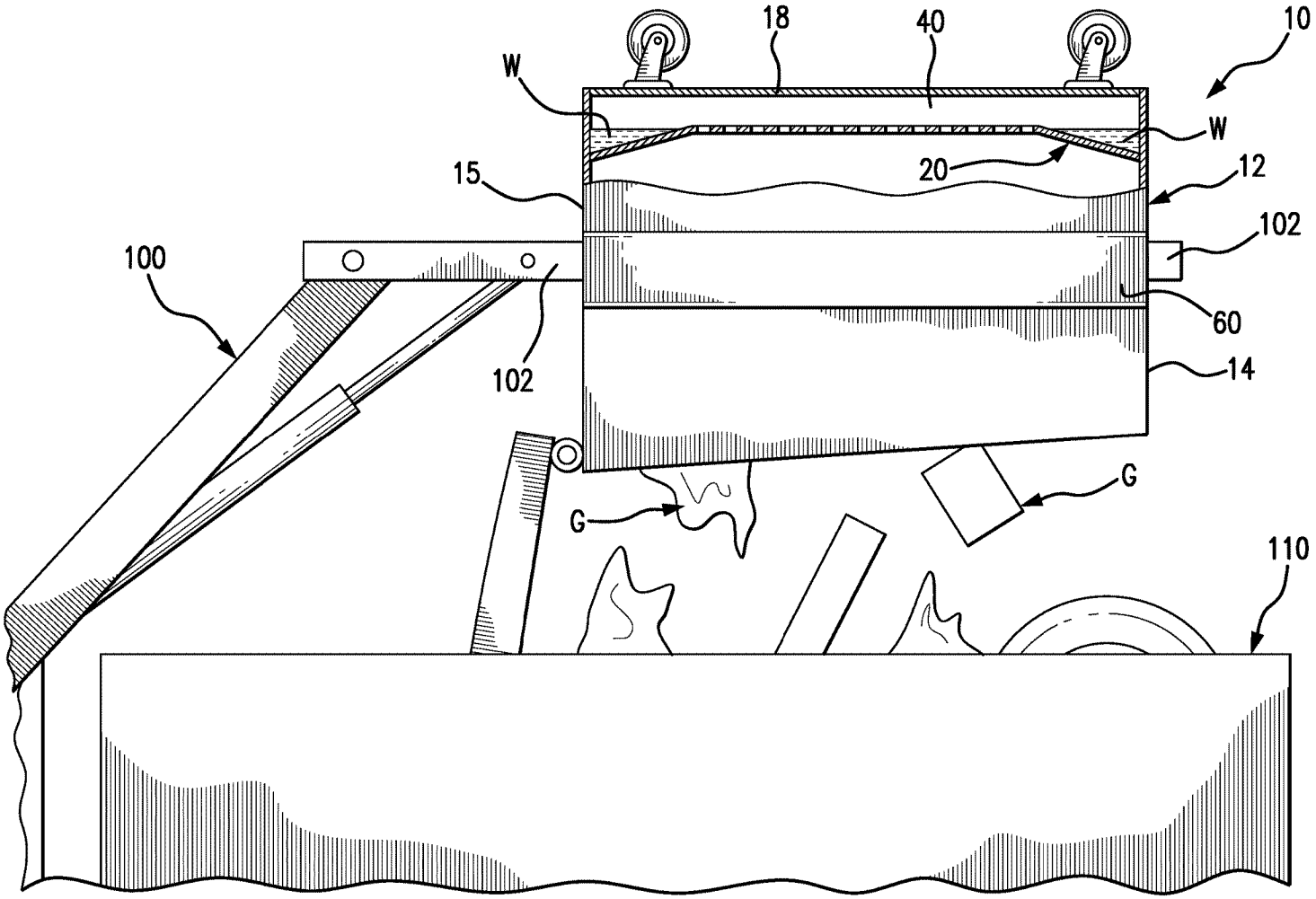
FIG. 5 is a side elevational view, in partial cross-section, showing the waste collection container lifted and inverted over a garbage collection truck with the waste contents of the container shown being dumped into the truck.
Figure 6:
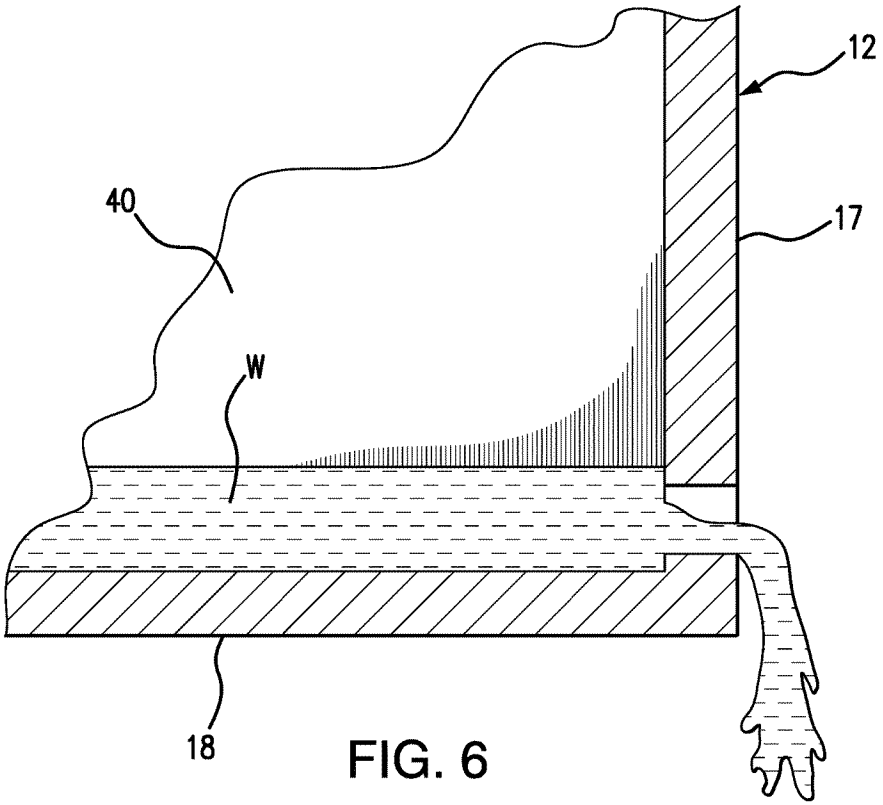
FIG. 6 is an isolated cross-sectional view of a bottom corner of the liquid collection reservoir of the waste collection container showing a drain hole for draining liquid from the liquid collection reservoir.

FIGS. 2 and 4 show a further embodiment of the drain grate, wherein a dome shaped cover 36 is provided over the drain grate 30. The drain grate cover 36 includes an arrangement of arcuate openings 38 along the front and rear sides, as seen in FIGS. 2 and 4. These arcuate openings 38 allow water and other liquid to run down the sloped floor 20 and through the arcuate openings 38, down through the drain grate 30 and into the liquid collection chamber 40. The dome shaped grate cover 36 helps to prevent garbage G and other debris from blocking and clogging the drain grate openings 32 so that rain water and other liquid can flow down into the lower liquid collection chamber without any obstruction. The rain water and other liquid W collected in the lower collection chamber drains out at least one drain opening on the side of the container body 12, as seen in FIG. 6. Any remaining rain water or other liquid W within the lower liquid collection chamber is trapped and prevented from reentering the primary collection chamber when the container 12 is lifted, inverted and dumped into a collection truck, as seen in FIG. 5. Specifically, the waste collection truck includes a hydraulic lift mechanism 100 having extension arms 102 that fit within sleeves 60 on opposite sides of the waste collection container 10, allowing the waste collection container 10 to be lifted, inverted and held above the collection area in the waste collection truck, as seen in FIG. 5, so that the garbage G and other debris is dumped into the truck. The sloped floor 20 creates a pooling area around the perimeter of the liquid collection chamber against the bottom surface of the sloped floor 20, as seen in FIG. 5. When the container body 12 is inverted, the pooling area in the liquid collection container is lower than the drain grate 30, thereby preventing the rain water and other collected liquid W from passing through the drain grate. Instead, the rain water and liquid W collects in the pooling area, as seen in FIG. 5, and remains trapped and segregated in the lower liquid collection chamber 40. Thus, the lower liquid collection chamber 40 serves as a liquid separation sump. One or more drain holes formed through the wall(s) of the container body 12 allow the collected liquid in the liquid collection chamber 40 to drain out of the container 10 as seen in FIG. 6.

While the present invention has been shown and described in accordance with several preferred and practical embodiments, it is recognized that departures from the instant disclosure are fully contemplated within the spirit and scope of the present invention which is not to be limited except as defined in the following claims as interpreted under the Doctrine of Equivalence.

What is claimed is:

1. A waste collection container comprising:

a container body including a base and vertical walls extending upwardly from the base including a front wall, a rear wall and opposite side walls, and the vertical walls terminating at a top edge surround an open top of the container body;

a raised floor within the container body supported on and fixedly attached and sealed to a ledge that is fixed to inner surfaces of the vertical walls, and the raised floor separating a plurality of interior chambers of the container body including a primary collection chamber above the raised floor and communicating with the open top of the container body, and a liquid collection chamber between the raised floor and the base of the container body, and the raised floor further including perimeter side portions surrounding a central portion, and the perimeter side portions being closed to prevent passage of liquid through the perimeter side portions; and a central, elongate drain grate in the central portion of the raised floor, and the drain grate including a plurality of drain openings communicating between the primary collection chamber and the liquid collection chamber, and the perimeter portions of the raised floor being sloped downwardly and inwardly from the inner surfaces of the vertical walls towards the elongate drain grate to direct liquid in the primary collection chamber towards the drain grate and through the drain grate openings for passage into the liquid collection chamber, and the perimeter portions of the raised floor and the inner surfaces of the vertical walls forming a liquid pooling area for trapping liquid around a perimeter of a bottom side of the raised floor within the liquid collection chamber and preventing the liquid in the pooling area from passing through the elongate drain grate and into the primary collection chamber when the waste collection container is inverted and the open top of the container body is below the base of the container body.

2. The waste collection container as recited in claim 1 wherein the central, elongate drain grate includes a plurality of slot openings in liquid flow communication between the primary collection chamber and the liquid collection chamber.

3. The waste collection container as recited in claim 1 wherein the central, elongate drain grate includes a drain grate cover with a plurality of openings in liquid flow communication between the primary collection chamber and the liquid collection chamber.

4. The waste collection container as recited in claim 3 wherein the drain grate cover is dome-shaped with a rounded top.

5. The waste collection container as recited in claim 4 wherein the drain grate cover includes a plurality of arcuate openings along a bottom edge of the drain grate cover in liquid flow communication between the primary collection chamber and the liquid collection chamber.

6. The waste collection container as recited in claim 1 wherein the raised floor includes a flat top surface.

7. The waste collection container as recited in claim 1 wherein the raised floor includes a ridged top surface.

8. The waste collection container as recited in claim 1 wherein the container body includes at least one drain hole formed through one of the vertical walls adjacent the base and in fluid flow communication with the liquid collection chamber for allowing collected liquid in the liquid collection chamber to drain to an exterior of the container body.

* * * * *